US007222556B2

(12) United States Patent
Tyler

(10) Patent No.: US 7,222,556 B2
(45) Date of Patent: May 29, 2007

(54) SHINGLE REMOVING MACHINE

(76) Inventor: Robert C. Tyler, 201 SW. 76th St., Lawton, OK (US) 73505

( * ) Notice: Subject to any disclaimer, the term of this patent is extended or adjusted under 35 U.S.C. 154(b) by 43 days.

(21) Appl. No.: 11/170,111

(22) Filed: Jun. 30, 2005

(65) Prior Publication Data

US 2007/0000354 A1 Jan. 4, 2007

(51) Int. Cl.
*E04D 15/00* (2006.01)

(52) U.S. Cl. ..... 81/45; 30/169; 30/170; 299/36.1

(58) Field of Classification Search ..... 81/45; 254/15; 301/70; 30/169, 170
See application file for complete search history.

(56) References Cited

U.S. PATENT DOCUMENTS

| | | | | | |
|---|---|---|---|---|---|
| 2,245,544 | A * | 6/1941 | Miller | 299/37.1 |
| 2,519,138 | A * | 8/1950 | Katz | 299/37.1 |
| 3,542,433 | A * | 11/1970 | Probst | 299/37.1 |
| 4,219,238 | A | 8/1980 | Sanchez | |
| 4,277,104 | A | 7/1981 | Sanchez | |
| 4,709,479 | A * | 12/1987 | Lavelette | 30/170 |
| 4,837,933 | A * | 6/1989 | Chapman | 30/170 |
| 4,880,491 | A * | 11/1989 | Jacobs et al. | 156/584 |
| 5,076,119 | A | 12/1991 | Wenz | |
| 5,218,766 | A * | 6/1993 | Himebaugh | 30/170 |
| 5,741,047 | A * | 4/1998 | Ordonez | 299/37.1 |
| 5,800,021 | A | 9/1998 | Derr | |
| 5,893,611 | A * | 4/1999 | Gamber | 299/41.1 |
| 5,921,155 | A | 7/1999 | Faller et al. | |
| 6,095,015 | A * | 8/2000 | Phelan | 81/45 |
| 6,116,117 | A * | 9/2000 | Nicolosi et al. | 81/45 |
| 6,393,948 | B1 * | 5/2002 | Hutchins | 81/45 |
| 6,711,971 | B1 * | 3/2004 | Morin | 81/45 |
| 7,013,758 | B1 * | 3/2006 | Gendron | 81/45 |
| 7,093,906 | B1 * | 8/2006 | Davidson | 299/36.1 |

FOREIGN PATENT DOCUMENTS

| | | |
|---|---|---|
| DE | 4221672 | 1/1994 |

* cited by examiner

*Primary Examiner*—Lee D. Wilson
*Assistant Examiner*—Robert Scruggs
(74) *Attorney, Agent, or Firm*—Richard C. Litman

(57) ABSTRACT

The shingle removing machine includes a frame supporting a power source, which, in turn, drives a lateral axle with a wheel at each end thereof, with each wheel having an eccentric pin driving a blade drive arm. Separate wheels support the frame. Each blade drive arm extends forwardly and has a relatively wide shingle removal blade at its forward end. The blades extend substantially the width of the machine. The forward ends of the blade drive arms are interconnected and include rollers riding on sloped ramps on the forward end of the frame. Rotation of the blade arm drive wheels reciprocates the blade drive arms forwardly and rearwardly, with the blades also lifting and lowering during the cycle as the forward ends of the arms ride up and down the ramps. The blade drive arm assembly may be quickly and easily disassembled for maintenance and repair in the field.

18 Claims, 5 Drawing Sheets

SHINGLE REMOVING MACHINE

BACKGROUND OF THE INVENTION

1. Field of the Invention

The present invention relates generally to tools and appliances used in the roofing trade. More particularly, the present invention comprises a powered shingle removing machine, which is pushed across a shingled roof, and which uses a powered, oscillating blade mechanism to lift and remove previously installed shingles.

2. Description of the Related Art

Most gabled roofs utilize wood sheathing overlaid with tarpaper, with lapped shingles forming the outermost cover. Various types of shingles are used, from glass fiber and other composites to older felt and tar composite material. While the tar-based shingle has been known for much longer than more modern materials and is not so durable as many modern shingle materials, it is often still the most cost-effective type of shingle for a roof, depending upon the environment and other factors.

Any shingle, regardless of type, will eventually deteriorate due to exposure to ultraviolet from the sun, moisture from precipitation, etc. While it is common to install a second layer of new shingles over a single existing layer, eventually the older shingles must be removed for replacement. This is a physically demanding task when performed by hand without the use of power machinery. Generally, various scraping tools, such as modified flat shovels, are used to wedge between the shingles and the underlying tarpaper or sheathing, with the edge of the shovel shearing or pulling the roofing nails which held the shingles in place. The physical effort involved, particularly when performed on a sloping roof, is extremely taxing.

Accordingly, various powered machines have been developed in the past to perform the task of removing shingles from roofs. Such machines typically include an electric motor or internal combustion engine that drives a mechanism, which, in turn, lifts and peels shingles from the roof surface. An example of such a machine is found in German Patent No. 4,221,672, published on Jan. 5, 1994. The device includes a wheel on a lateral axis, with the wheel having an eccentric pin extending therefrom. The pin engages a single, forwardly extending lever, with a fixed pin or axle extending laterally through a slot in the lever to restrain movement of the lever. A single, relatively narrow comb extends from the forward end of the lever.

None of the above inventions and patents, taken either singly or in combination, is seen to describe the instant invention as claimed. Thus, a shingle removing machine solving the aforementioned problems is desired.

SUMMARY OF THE INVENTION

The shingle removing machine includes a frame having a power plant (internal combustion engine, electric, hydraulic, or pneumatic motor, etc.) with a handle and controls extending therefrom. The power plant drives a lateral axle, which in turn has a drive arm wheel at each end thereof. Each wheel has an eccentric pin, with a blade drive arm extending forwardly from each eccentric. The blade drive arms are interconnected at their forward ends, and drive a pair of relatively wide shingle removal blades. The forward ends of the blade drive arms include rollers, which rest upon sloped ramps extending from the forward end of the frame. Rotation of the blade arm drive wheels results in forward and rearward reciprocation of the drive arms and blades, with the rollers and ramps causing the blades to lift and lower during each cycle to lift and separate the shingles from the underlying surface. The shingle removing machine may be disassembled easily in the field for repair or replacement of components as required.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a powered machine for removing conventional lapped shingles from a roof. A blade assembly is oscillated forwardly and rearwardly to drive between the shingles and the underlying roofing paper or sheathing, with the geometry of the mechanism also lifting the shingles slightly when the blades have been driven to their forwardmost position.

Figure 1:
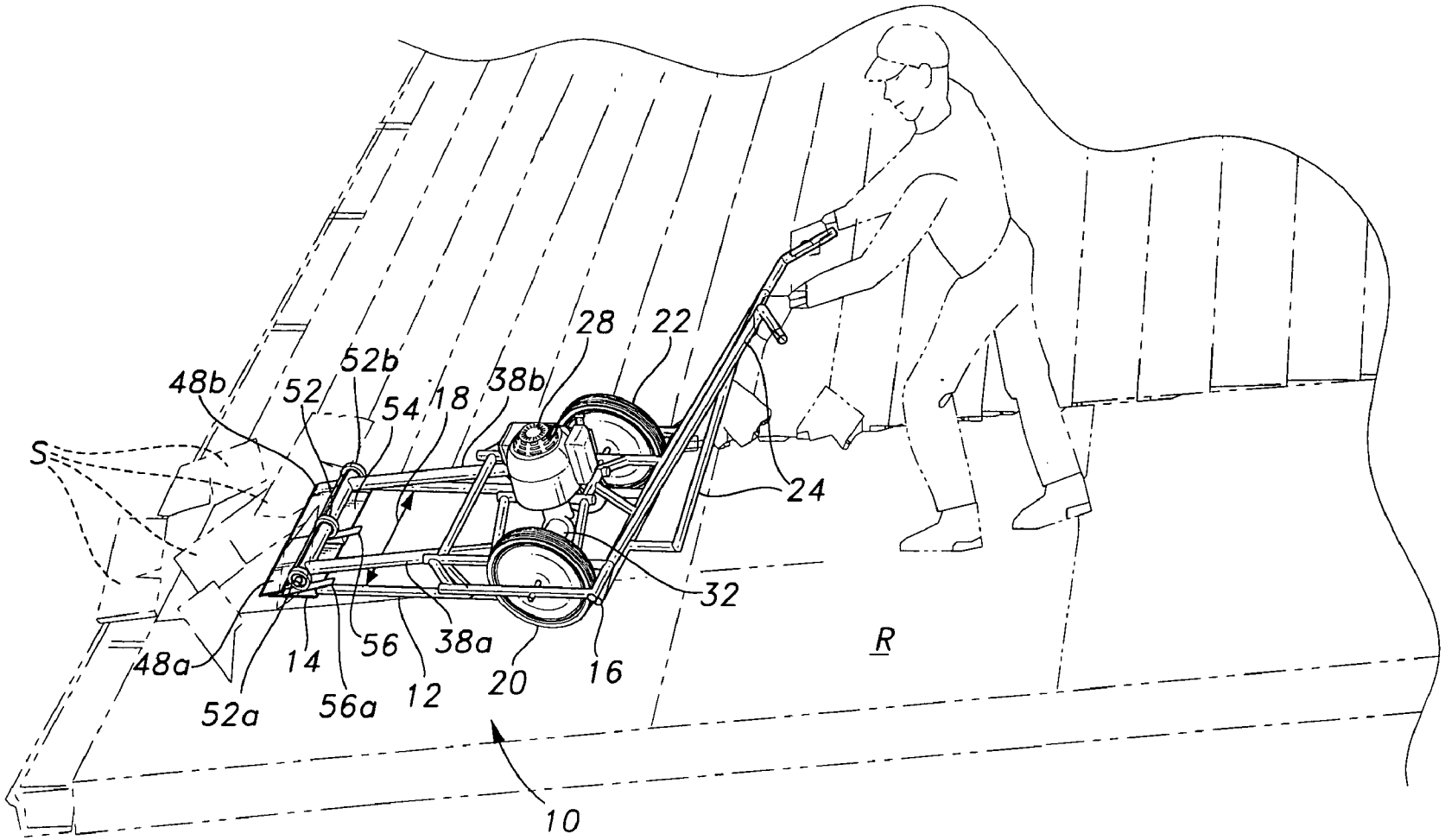
FIG. 1 is an environmental, perspective view of a shingle removing machine according to the present invention, showing its operation in the removal of shingles from a roof.

FIG. 1 of the drawings provides an environmental perspective view of the shingle removing machine 10 in use removing shingles S from a roof R. The machine 10 includes a frame 12 having opposite forward and rearward ends, respectively 14 and 16, and a width 18. The frame 12 may be formed of any suitable materials, e.g., steel tubing, which has been welded to form the frame assembly 12. This provides an extremely strong and rigid, but relatively light structure to support the various components of the machine and to provide the required durability to withstand the forces involved during operation of the device. A deflector or guard (not shown, in order to show the underlying structure and components) may be installed over at least the forward portion of the frame in order to keep loosened shingles from falling into the frame and moving components.

Figure 2:
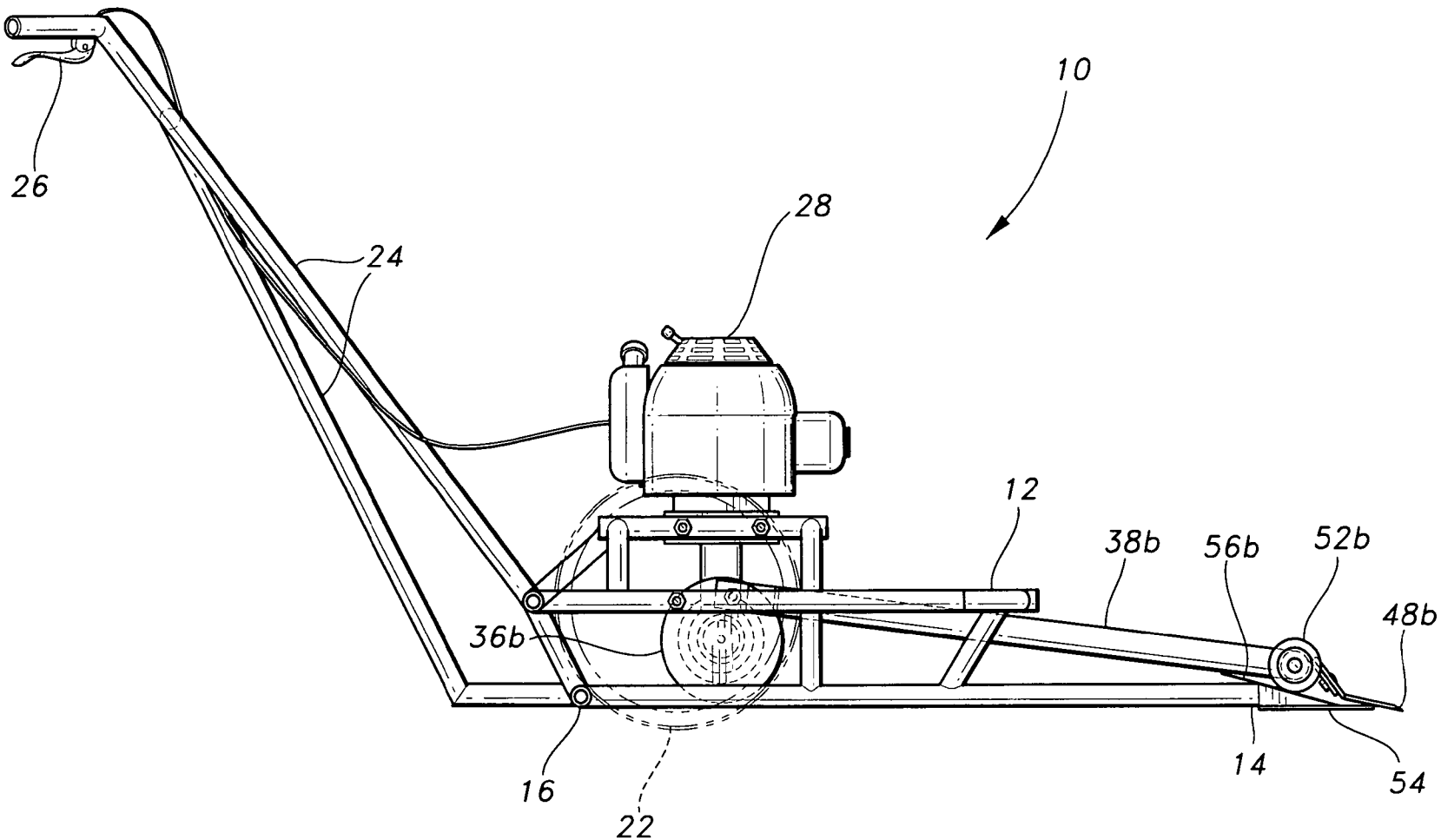
FIG. 2 is a right side elevation view of the shingle removing machine of the present invention, showing further details thereof.

Left and right support wheels, respectively 20 and 22, extend from the frame 12 generally adjacent the rearward portion thereof, and serve to support most of the weight of the machine. A handlebar assembly 24 extends from the rearward end 16 of the frame 12, enabling an operator to control and maneuver the machine. The handlebar assembly 24 preferably includes suitable controls 26 (shown in FIG. 2) for the prime mover 28 (e.g., internal combustion engine, as shown, or alternatively an electric, hydraulic, or pneumatic motor, etc.).

Figure 4:
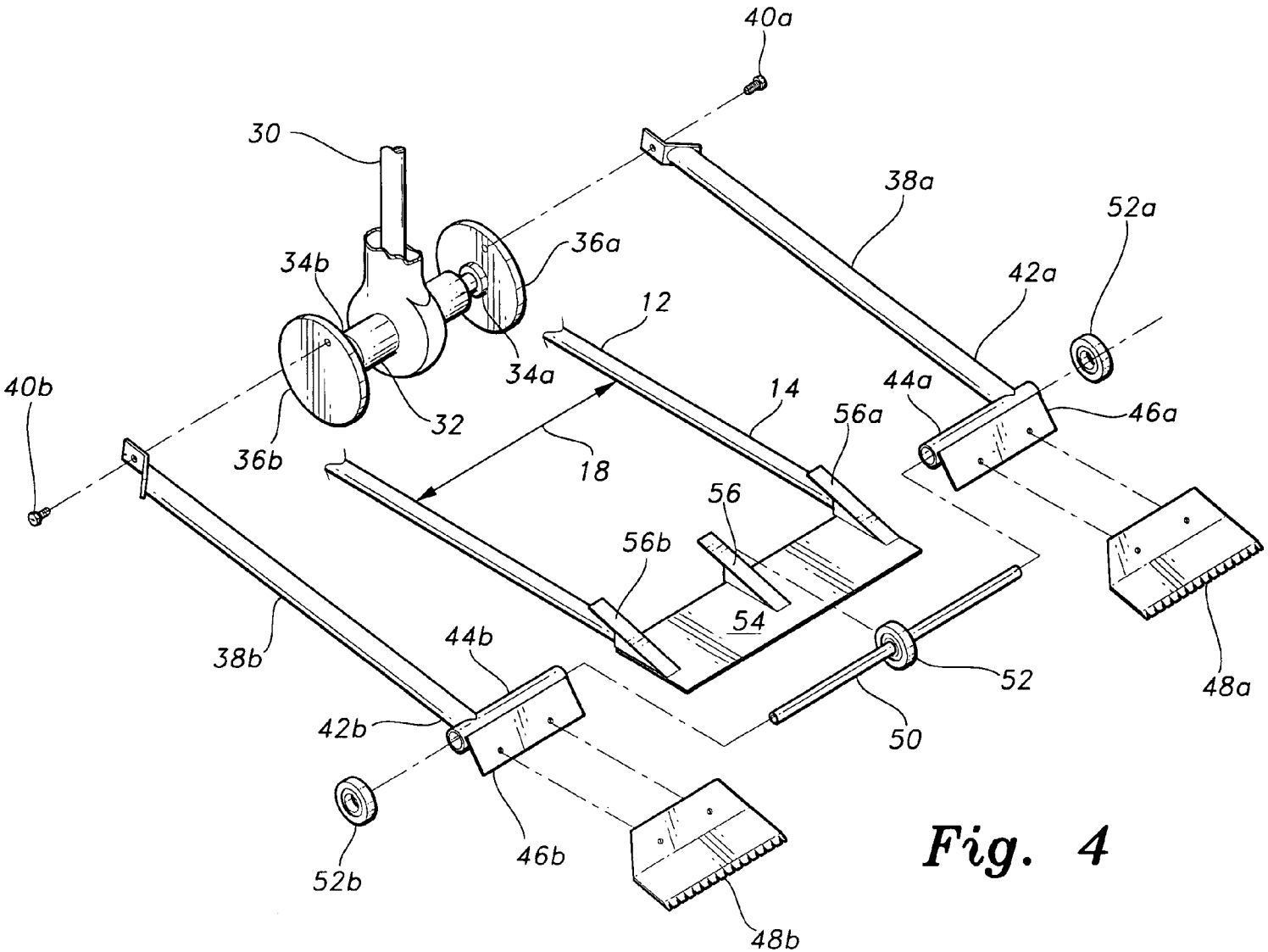
FIG. 4 is an exploded perspective view of the blade drive arm axle, wheels, and blade drive arm assembly of the shingle removing machine of the present invention, showing the various components and their relationships.

FIG. 4 provides an exploded perspective view of the forward portion of the frame 12 and the drive or actuating mechanism for the shingle removing machine. The engine or motor 28 drives a rotary driveshaft 30 within a tubular housing, with the driveshaft 30 extending directly from the engine or motor 28 and conventionally geared to rotate a drive arm axle 32 disposed laterally across the frame 12. It will be understood that the power train used to translate rotary motion of the engine or motor shaft into rotation of the drive arm axle 32 is not critical, and any power train or coupling system known in the art may be used to translate rotation of the motor shaft into rotation of the drive arm axle 32. An internal combustion engine and drive system, such as that used in a conventional garden tiller, may be readily adapted for use with the present machine 10. The drive arm axle 32 has a left end 34*a* and opposite right end 34*b*, with a left and a right blade drive arm wheel, respectively 36*a* and 36*b*, secured to the two drive arm axle ends 34*a* and 34*b*. It should be understood that these blade drive arm wheels 36*a* and 36*b* are sufficiently high in the frame 12 that they do not contact the underlying surface, i.e., they do not provide any propulsion for the machine 10 per se. Rather, they serve to actuate the blade mechanism disposed at the front end 14 of the frame 12.

Left and right blade drive arms, respectively 38*a* and 38*b*, attach to their respective blade arm drive wheels 36*a* and 36*b* by means of eccentric pins 40*a* and 40*b* which extend laterally from their respective drive wheels. The two blade drive arms 38*a* and 38*b* extend forwardly from their attachment to their drive wheels 36*a* and 36*b* and provide the driving linkage for a pair of shingle removal blades, as discussed further below. Each blade drive arm 38*a*, 38*b* has a forward end, respectively 42*a* and 42*b*, with a laterally disposed blade mount tube, respectively 44*a* and 44*b*, extending inwardly (i.e., toward one another in the completed assembly) from the forward ends 42*a*, 42*b* of the two blade drive arms 38*a*, 38*b*.

Each blade mount tube 44*a* and 44*b* includes a blade mount plate, respectively 46*a* and 46*b*, extending generally forwardly therefrom. The blade mount plates 46*a*, 46*b* provide for the removable and replaceable attachment of left and right shingle removal blades, respectively 48*a* and 48*b*, by means of conventional threaded fasteners or other suitable attachment means. The shingle removal blades 48*a*, 48*b* extend forwardly from the blade mount plates 46*a*, 46*b* and comprise the forwardmost extremity of the machine 10. The blades 48*a*, 48*b* are preferably conventional; such blades are readily available commercially to facilitate replacement when required. It will be noted in FIG. 1 of the drawings that the two blades 48*a* and 48*b* combine to span essentially the entire width 18 of the machine 10 in the completed assembly.

The two blade drive arms 38*a*, 38*b* with their blade mount tubes 44*a*, 44*b* and blade mount plates 46*a*, 46*b* are preferably provided as two separate left and right hand components, in order to facilitate removal and replacement of components in the field. The forward ends 42*a*, 42*b* of the two drive arms are secured to one another by an interconnecting shaft 50 which passes concentrically through the two hollow blade mount tubes 44*a* and 44*b*. A central roller bearing 52 is installed on the lateral interconnecting shaft 50 before assembling the two blade mount tubes 44*a* and 44*b* on the shaft 50, with a left and a right hand roller bearing, respectively 52*a* and 52*b*, being installed on the shaft 50 outboard of the respective blade mount tubes 44*a* and 44*b* after they have been installed on the shaft 50.

The forward end 14 of the frame 12 includes a low, flat plate 54 extending thereacross, which connects the to longitudinal forward frame members together. The plate 54 also serves as a support for the forward ends of the blade drive arms 38*a*, 38*b* and their various attachments described further above. The plate 54 includes a series of roller support ramps, comprising a central ramp 56 and left and right ramps 56*a* and 56*b*. The roller bearings 52 through 52*b* ride on their respective ramps 56 through 56*b*, with the ramps imparting some vertical motion to the blades 48*a*, 48*b* as they are reciprocated forwardly and rearwardly by the blade drive arms 38*a* and 38*b* and drive mechanism.

Figure 3A:
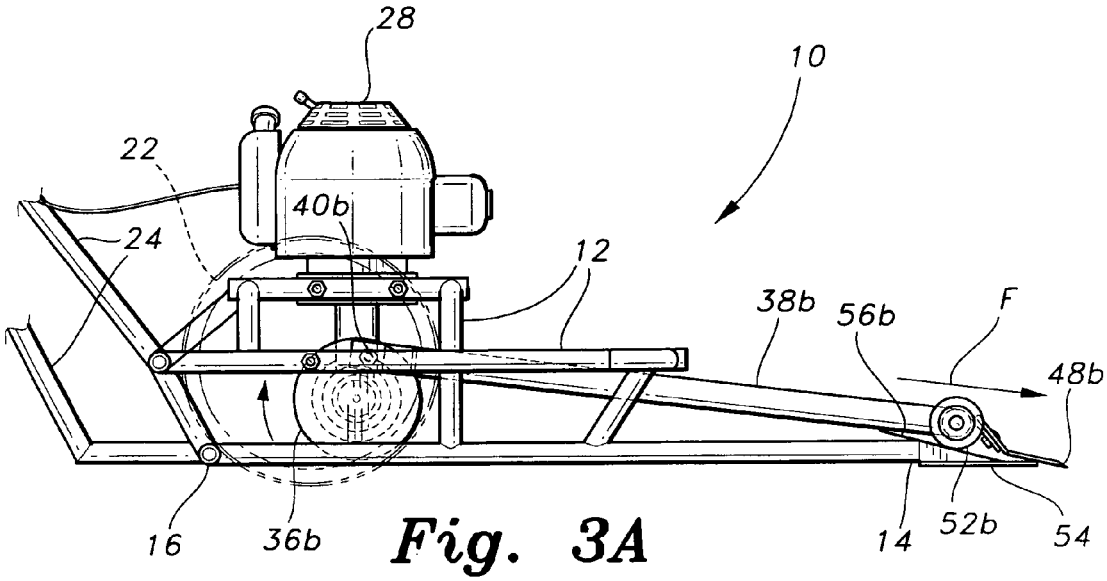
FIGS. 3A, 3B, 3C and 3D are a sequential series of right side elevation views of the shingle removing machine of the present invention showing the position of the blade drive arms and blades during the rotation of the blade drive arm wheels.
Figure 3B:
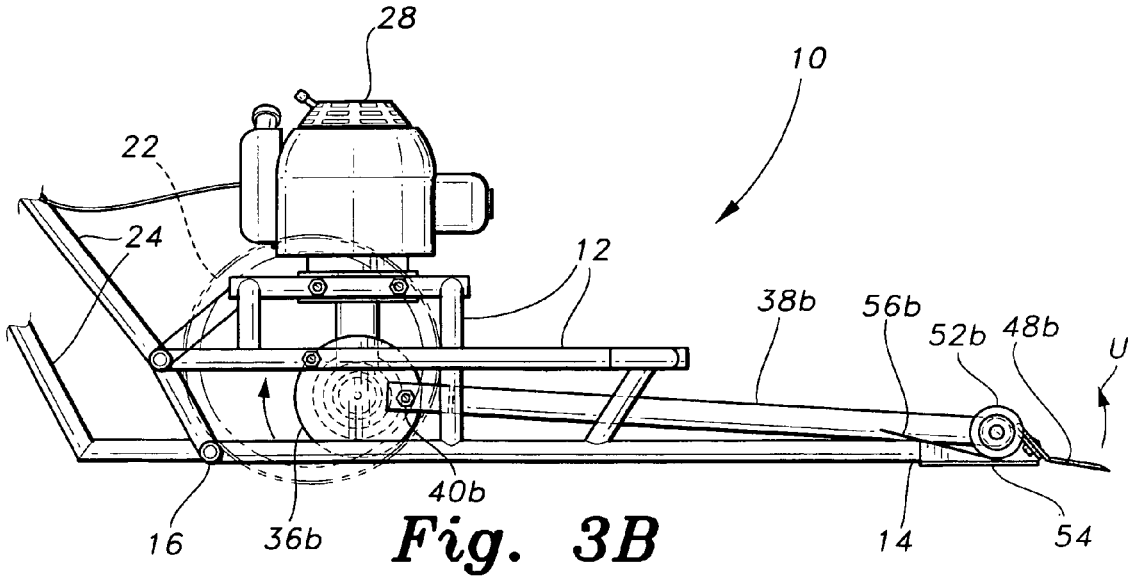

FIGS. 3A through 3D illustrate the relative motion of the shingle removal blades during the operation of the machine 10. While FIGS. 3A through 3B illustrate the operation of the machine 10 only from the right side, it will be understood that the two blade arm drive wheels 36*a* and 36*b* rotate in unison with one another and that the two blade drive arms 38*a*, 38*b* are immovably affixed relative to one another. Thus, the explanation of the operation of the right side components as shown in FIGS. 3A through 3D will be seen to cover the simultaneous operation of the components of the opposite side of the machine as well.

In FIG. 3A, the right side blade arm drive wheel 36*b* is rotated to position the eccentric pin 40*b* at the top of the drive wheel, thus positioning the attachment end of the blade drive arm 38*b* at the same point. The uppermost portion of the wheel 36*b* is moving primarily in a forward direction as the wheel rotates clockwise (as seen from the right side in FIGS. 3A through 3D), thus driving the blade drive arm 38*b* and blade 48*b* in a predominately forward direction, as shown by the forward movement arrow F in FIG. 3A. The forwardly and downwardly sloped ramps, e.g., ramp 52*b* in FIG. 3A, allow the blade 48*b* (and its attached counterpart) to lower to the level of the underlying surface as it is being thrust forward, thus passing between the overlying shingles and the underlying surface to separate the shingles from the underlying surface.

As the blade arm drive wheel 36*b* rotates another ninety degrees, the eccentric pin 40*b* and attachment end of the blade drive arm 38*b* will rotate to the forwardmost portion of the wheel 36*b*, as shown in FIG. 3B. This portion of the wheel is moving primarily downwardly, with very little forward or rearward motion imparted to the blade drive arm 38*b* at this point. Rather, the attachment end of the blade drive arm at the eccentric pin 40*b* is moving primarily downward. This results in a slight upward movement of the shingle removal blade 48*b* due to its rotation about the fulcrum of the roller bearing 52*b*, as indicated by the upward movement arrow U in FIG. 3B, thus lifting the shingles after being driven forwardly beneath them, as shown in FIG. 3A and described further above.

Figure 3C:
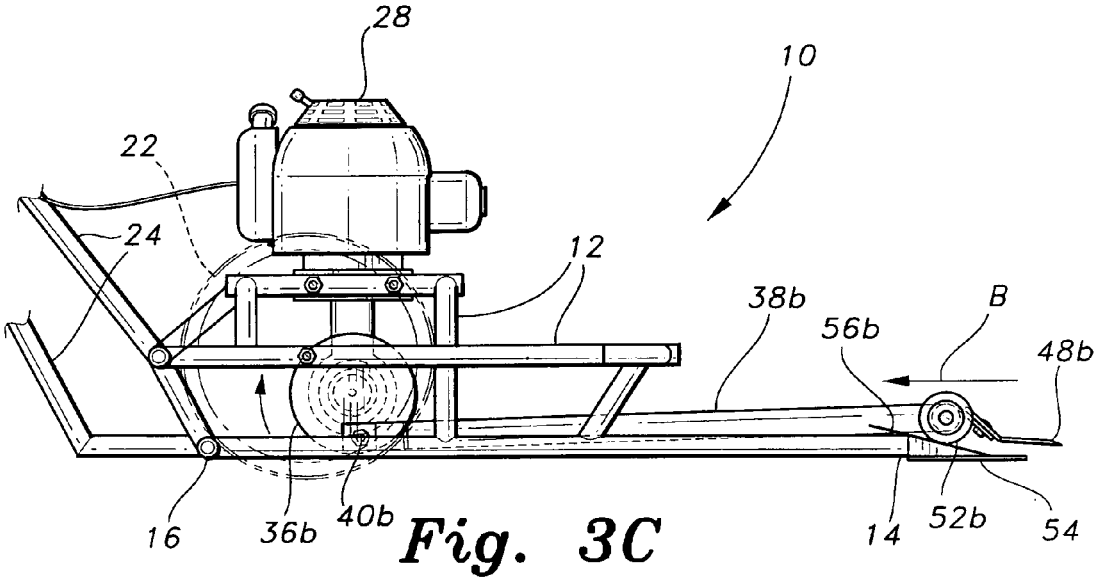

In FIG. 3C, the blade arm drive wheel 36*b* has rotated another ninety degrees, to position the eccentric pin 40*b* at the bottom of the wheel, where its movement is predominately to the rear in the clockwise rotation of the drive wheel 36*b*. This draws the blade arm 38*b*, and its attached shingle removal blade 48*b*, rearwardly, as indicated by the rearward or backward arrow B in FIG. 3C, allowing the machine 10 to be advanced by the operator. At the same time, the blade 48*b* remains in a relatively elevated position due to the relatively low position of the eccentric pin 40*b* and attachment end of the blade drive arm, thus holding the shingles clear of the underlying surface during this portion of the operational cycle.

Figure 3D:
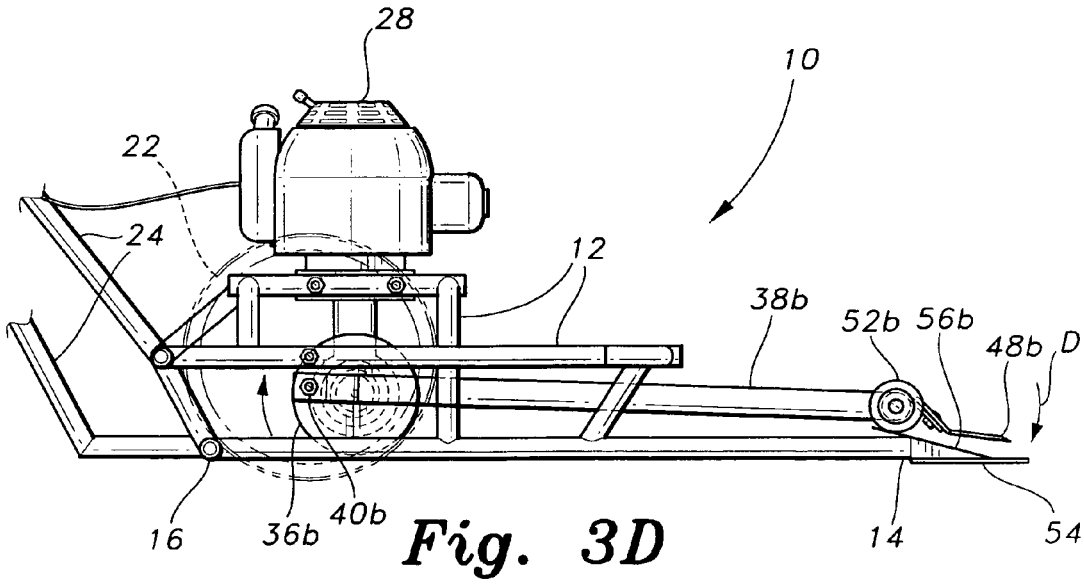

FIG. 3D illustrates the position of the drive components when the drive wheel 36*b* has rotated 270 degrees clockwise from its initial position of FIG. 3A. In FIG. 3D, the eccentric pin 40*b* is positioned at the rearward or trailing side of the blade arm drive wheel, thus drawing the blade drive arm 38*b* to its rearwardmost position and raising the rearward end of the blade drive arm. This draws the roller bearings, e.g., right hand bearing 52*b*, rearwardly and upwardly along their corresponding ramps, e.g., ramp 56*b*, thus lifting the shingle removal blade 56*b* to continue to hold any shingles clear of the underlying surface. However, the primary component of motion of the eccentric pin 40*b* and attachment end of the drive arm 38*b* is upward at this point, thus resulting in a slight downward motion of the blade 48*b* (as shown by the downward arrow D in FIG. 3D) before it is thrust forwardly again as the cycle continues. This allows the operator to push the machine 10 forward, sliding the front plate forward to the attachment point of the shingles. As the drive wheel 36*b* continues to rotate back to the position shown in FIG. 3A, the blade drive arm 38*b* and shingle removal blade 48*b* are driven forwardly and slightly downwardly to penetrate beneath the next area of attached shingles, thus repeating the cycle.

In conclusion, the shingle removing machine greatly facilitates the removal of shingles from a roof. The geometry of the drive arm actuation oscillates and reciprocates the shingle removing blades in an efficient pattern, wedging beneath and then lifting the shingles clear of the underlying roof structure. The structure of the present machine greatly simplifies maintenance of the device, enabling the operator of the machine to replace the shingle removal blades, and other moving components, quickly and easily. Accordingly, the present shingle removing machine will prove to be a valuable addition to the tools and equipment inventory of the professional roofing contractor and others who have occasion to perform such work.

It is to be understood that the present invention is not limited to the embodiment described above, but encompasses any and all embodiments within the scope of the following claims.

I claim:

1. A shingle removing machine, comprising:

a frame having a forward end and defining a width;

a left and a right support wheel extending from said frame;

a prime mover secured to said frame;

a drive arm axle extending laterally across said frame, said drive arm axle having opposed left and right ends;

a power train coupling the prime mover to the drive arm axle for translating output of the prime mover into rotation of the drive arm axle;

a blade drive arm wheel disposed at each of the ends of said drive arm axle;

an eccentric pin extending laterally from each said blade drive arm wheel;

a blade drive arm extending forwardly from each said eccentric pin, each said blade drive arm having a forward end;

a shingle removal blade extending forwardly from each said blade drive arm, said blades combining to provide a total blade width substantially equal to the width of said frame;

a laterally disposed blade mount tube extending inwardly from the forward end of each said blade arm;

at least one blade mount roller mounted on each said blade mount tube; and a plurality of roller ramps extending from the forward end of said frame, each said blade mount roller riding upon one of said roller ramps as each said blade drive arm is reciprocated by said blade drive arm wheel.

2. The shingle removing machine according to claim 1, further including:

a blade mount plate extending forwardly from each said blade mount tube, said shingle removal blade being removably secured to and extending forwardly from each said blade mount plate;

an interconnecting shaft extending through each said blade mount tube; and a plurality of blade mount rollers disposed upon said interconnecting shaft, the rollers being disposed between and outwardly from each said blade mount tube.

3. The shingle removing machine according to claim 1, further including:

a handle assembly extending rearwardly from said frame; and at least one prime mover control disposed upon said handle assembly.

4. The shingle removing machine according to claim 1, wherein said prime mover comprises an internal combustion engine.

5. The shingle removing machine according to claim 1, wherein said frame is formed of welded steel tube.

6. A shingle removing machine, comprising:

a frame having a forward end and defining a width;

a left and a right support wheel extending from said frame;

a prime mover secured to said frame;

a blade drive mechanism selectively driven by said prime mover;

a left and a right blade drive arm disposed within said frame, each said blade drive arm being driven by said blade drive mechanism and having a forward end;

a laterally disposed blade mount tube extending inwardly from the forward end of each said blade drive arm;

a shingle removal blade extending forwardly from each said blade mount tube;

at least one blade mount roller extending from each said blade mount; and a plurality of roller ramps extending from the forward end of said frame, each said blade mount roller riding upon one of said roller ramps as each said blade drive arm is reciprocated by said blade drive mechanism.

7. The shingle removing machine according to claim 6, wherein said blade drive mechanism further comprises:

a drive arm axle extending laterally across said frame, said drive arm axle having opposed left and right ends;

a rotary driveshaft extending directly between said prime mover and said drive arm axle;

a blade drive arm wheel disposed at each of the ends of said drive arm axle;

an eccentric pin extending laterally from each said blade drive arm wheel; and wherein each said blade drive arm extends forwardly from one said eccentric pin.

8. The shingle removing machine according to claim 6, further including:

a blade mount plate extending forwardly from each said blade mount tube, said shingle removal blade being removably secured to, and extending forwardly from, each said blade mount plate;

an interconnecting shaft extending through each said blade mount tube; and a plurality of blade mount rollers disposed upon said interconnecting shaft, the rollers being disposed between and outwardly from each said blade mount tube.

9. The shingle removing machine according to claim 6, wherein said blades combine to provide a total blade width substantially equal to the width of said frame.

10. The shingle removing machine according to claim 6, further including:

a handle assembly extending rearwardly from said frame; and at least one prime mover control disposed upon said handle assembly.

11. The shingle removing machine according to claim 6, wherein said prime mover comprises an internal combustion engine.

12. The shingle removing machine according to claim 6, wherein said frame is formed of welded steel tube.

13. A shingle removing machine, comprising:

a frame having a forward end;

a left and a right support wheel extending from said frame;

a prime mover secured to said frame;

a blade drive mechanism selectively driven by said prime mover;

a left and a right blade drive arm disposed within said frame, each said blade drive arm being driven by said blade drive mechanism and having a forward end;

a laterally disposed blade mount tube extending inwardly from the forward end of each said blade drive arm;

a blade mount plate extending forwardly from each said blade mount tube;

a shingle removal blade removably secured to and extending forwardly from each said blade mount plate;

an interconnecting shaft extending through each said blade mount tube;

a blade mount roller disposed upon said interconnecting shaft, the roller being disposed between and outwardly from each said blade mount tube;

a plurality of roller ramps extending from the forward end of said frame, each said blade mount roller riding upon one of said roller ramps as each said blade drive arm is reciprocated by said blade drive mechanism.

14. The shingle removing machine according to claim 13, wherein said blade drive mechanism further comprises:

a drive arm axle extending laterally across said frame, said drive arm axle having opposed left and right ends;

a rotary driveshaft extending directly between said prime mover and said drive arm axle;

a blade drive arm wheel disposed at each of the ends of said drive arm axle; and an eccentric pin extending laterally from each said blade drive arm wheel, each said blade drive arm extending forwardly from one said eccentric pin.

15. The shingle removing machine according to claim 13, wherein said blades combine to provide a total blade width substantially equal to the width of said frame.

16. The shingle removing machine according to claim 13, further including:

a handle assembly extending rearwardly from said frame; and at least one prime mover control disposed upon said handle assembly.

17. The shingle removing machine according to claim 13, wherein said prime mover comprises an internal combustion engine.

18. The shingle removing machine according to claim 13, wherein said frame is formed of welded steel tube.

* * * * *